US006276613B1

(12) United States Patent
Kramer

(10) Patent No.: US 6,276,613 B1
(45) Date of Patent: Aug. 21, 2001

(54) CHEMICAL FOAMING SYSTEM FOR FLOOR CLEANING MACHINE

(75) Inventor: Michael G. Kramer, Springdale, AR (US)

(73) Assignee: Alto US, Inc., Chesterfield, MO (US)

( * ) Notice: Subject to any disclaimer, the term of this patent is extended or adjusted under 35 U.S.C. 154(b) by 0 days.

(21) Appl. No.: 09/511,176

(22) Filed: Feb. 22, 2000

Related U.S. Application Data

(60) Provisional application No. 60/121,176, filed on Feb. 22, 1999.

(51) Int. Cl.[7] ..... A62C 13/62

(52) U.S. Cl. ..... 239/304; 239/407; 239/413; 239/416.2; 134/102.2; 15/320

(58) Field of Search ..... 239/304, 407, 239/413, 416.2; 134/102.2, 21, 34; 15/320, 50.1

(56) References Cited

U.S. PATENT DOCUMENTS

| | | | | |
|---|---|---|---|---|
| 2,212,598 | | 8/1940 | Hagist . | |
| 2,384,458 | | 9/1945 | Dubay . | |
| 2,868,584 | * | 1/1959 | Faust | 239/366 |
| 2,960,710 | | 11/1960 | McKeegan . | |
| 3,212,762 | | 10/1965 | Carroll et al. . | |
| 3,392,418 | | 7/1968 | Schowalter . | |
| 3,676,889 | | 7/1972 | Edlin . | |
| 3,940,826 | | 3/1976 | Phillips et al. . | |
| 4,000,536 | | 1/1977 | Nayfa et al. . | |
| 4,061,001 | | 12/1977 | von der Eltz et al. . | |
| 4,107,075 | | 8/1978 | Kramer . | |
| 4,167,798 | | 9/1979 | Klügl et al. . | |
| 4,167,799 | | 9/1979 | Webb . | |
| 4,429,432 | | 2/1984 | Copeland et al. . | |
| 4,667,364 | | 5/1987 | Meili . | |
| 4,780,243 | * | 10/1988 | Edgley et al. | 252/307 |
| 4,974,618 | | 12/1990 | Nysted . | |
| 5,133,107 | | 7/1992 | MacDonald . | |
| 5,813,086 | | 9/1998 | Ueno et al. . | |
| 5,853,814 | | 12/1998 | Murphy . | |

* cited by examiner

*Primary Examiner*—David A. Scherbel
*Assistant Examiner*—Dinh Q. Nguyen
(74) *Attorney, Agent, or Firm*—Senniger, Powers, Leavitt & Roedel

(57) ABSTRACT

A chemical foaming system for use in a floor cleaning machine has a foam generator and a delivery system upstream of the foam generator in communication with a source of pressurized fluid and a source of liquid cleaning solution. The delivery system delivers pressurized fluid and liquid cleaning solution to the foam generator. A dispensing system is disposed downstream of the foam generator for dispensing foam generated by the foam generator onto the floor being cleaned. The foam generator has a pair of independent foaming chambers in generally parallel flow relationship intermediate the delivery system and the dispensing system whereby a portion of pressurized fluid and liquid cleaning solution delivered to the foam generator by the delivery system flows into one of the foaming chambers. The remaining portion of the pressurized fluid and liquid cleaning solution delivered to the foam generator flows into the other foaming chamber. Each foaming chamber is adapted for generating a foam therein for dispensing onto the floor by the dispensing system.

12 Claims, 10 Drawing Sheets

CHEMICAL FOAMING SYSTEM FOR FLOOR CLEANING MACHINE

REFERENCE TO RELATED APPLICATIONS

This application claims the benefit of U.S. Provisional Application No. 60/121,176 filed Feb. 22, 1999 and incorporated herein by reference.

BACKGROUND OF THE INVENTION

This invention relates to a chemical foaming system, and more particularly to such a foaming system incorporated into a floor cleaning machine.

In one type of conventional floor cleaning machines, and more particularly a bonnet-type carpet cleaning machine, a cleaning chemical is applied to a bonnet of the machine and the bonnet is worked over the carpet to clean the carpet. The intent is for the soiling in the carpet to transfer to the bonnet. One disadvantage associated with this type of cleaning machine is that the bonnet instead tends to smear the soiling over the carpet. In a conventional rotary brush carpet cleaning machine, cleaning chemical is metered onto the carpet and worked into the carpet with a rotating nylon brush. The intent of this type of cleaning machine is to work the cleaning chemical into the carpet and capture the dirt within the chemical. This type of machine has also proven to be disadvantageous because it tends to leave wet spots on the carpet.

To this end, it is known to meter a dry foam onto the carpet instead of a liquid. Dry foam does not instantly revert back into a liquid, allowing any excess foam to be spread over the carpeting by the rotating brush and inhibiting the leaving of wet spots in the carpet. However, existing machines designed to employ dry foam cleaning technology are large and complex, requiring a substantial amount of labor and skill to operate.

SUMMARY OF THE INVENTION

Among the several objects of this invention are the provision of a chemical foaming system which generates a dry foam; the provision of such a system which minimizes foam production delay; the provision of such a system which can be used in combination with a carpet cleaning machine; and the provision of a carpet cleaning machine incorporating such a chemical foaming system which is relatively lightweight and easy to operate.

In general, a chemical foaming system for use in a floor cleaning machine comprises a foam generator and a delivery system upstream of the foam generator in communication with a source of pressurized fluid and a source of liquid cleaning solution. The delivery system delivers pressurized fluid and liquid cleaning solution to the foam generator. A dispensing system is disposed downstream of the foam generator for dispensing foam generated by the foam generator onto the floor being cleaned. The foam generator comprises a pair of independent foaming chambers in generally parallel flow relationship intermediate the delivery system and the dispensing system whereby a portion of pressurized fluid and liquid cleaning solution delivered to the foam generator by the delivery system flows into one of the foaming chambers. The remaining portion of the pressurized fluid and liquid cleaning solution delivered to the foam generator flows into the other foaming chamber. Each foaming chamber is adapted for generating a foam therein for dispensing onto the floor by the dispensing system.

In another embodiment, a chemical foaming system of the present invention for use in a floor cleaning machine comprises a source of pressurized fluid, a solution tank containing a liquid cleaning solution, and a foam generator in fluid communication with the source of pressurized fluid and with the solution tank for receiving pressurized fluid from the source of pressurized fluid and liquid cleaning solution from the solution tank and generating a foam therefrom to be dispensed onto a floor being cleaned. A fluid line provides fluid communication between the source of pressurized fluid and the foam generator for conveying pressurized fluid to the foam generator. A restriction in the fluid line upstream of the foam generator has an orifice sized to restrict the flow of pressurized fluid through the fluid line, thereby increasing the flow velocity of pressurized fluid downstream of the restriction for delivery to the foam generator.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
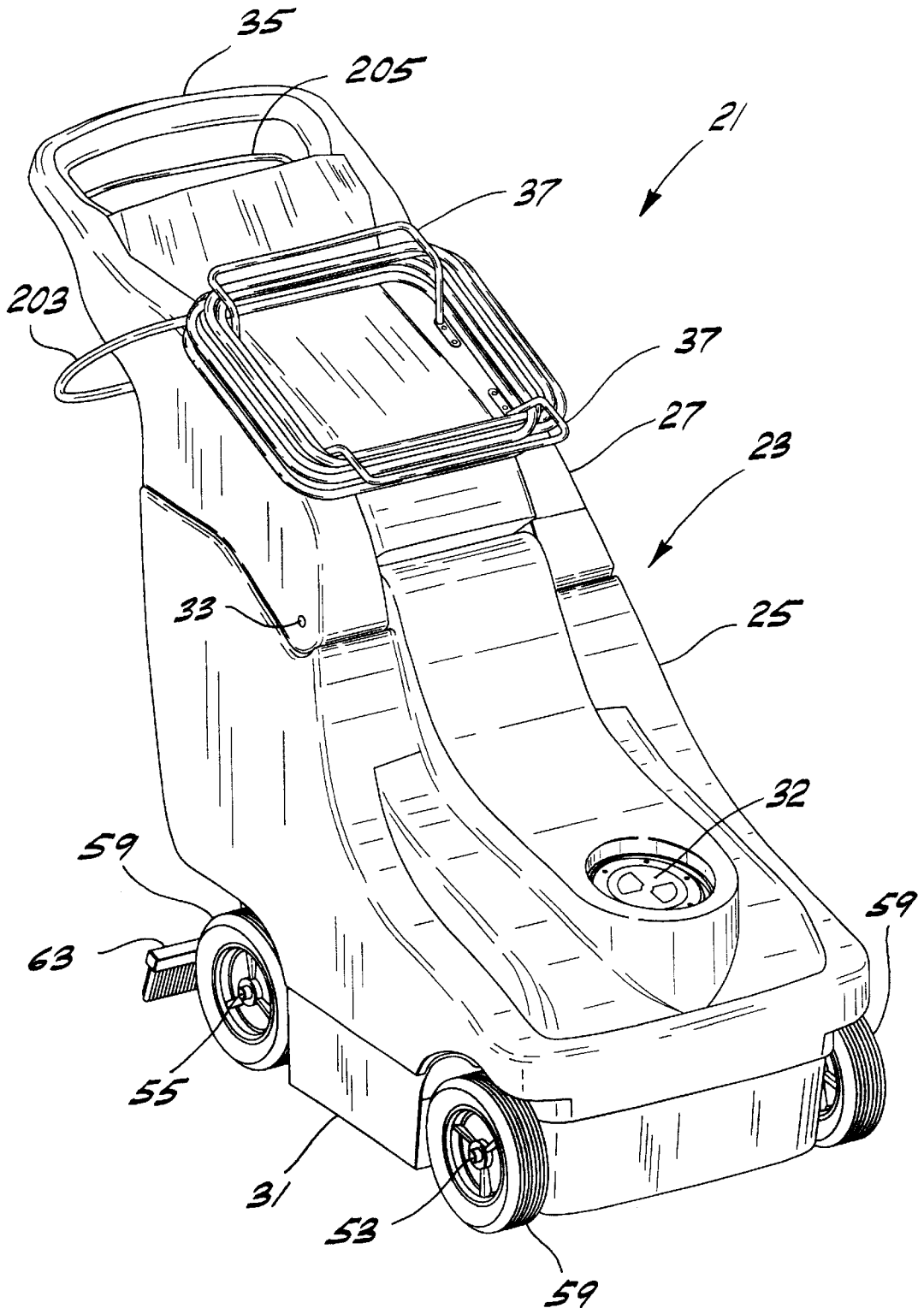
FIG. 1 is a perspective of a floor cleaning machine of the present invention incorporating a chemical foaming system.
Figure 2:
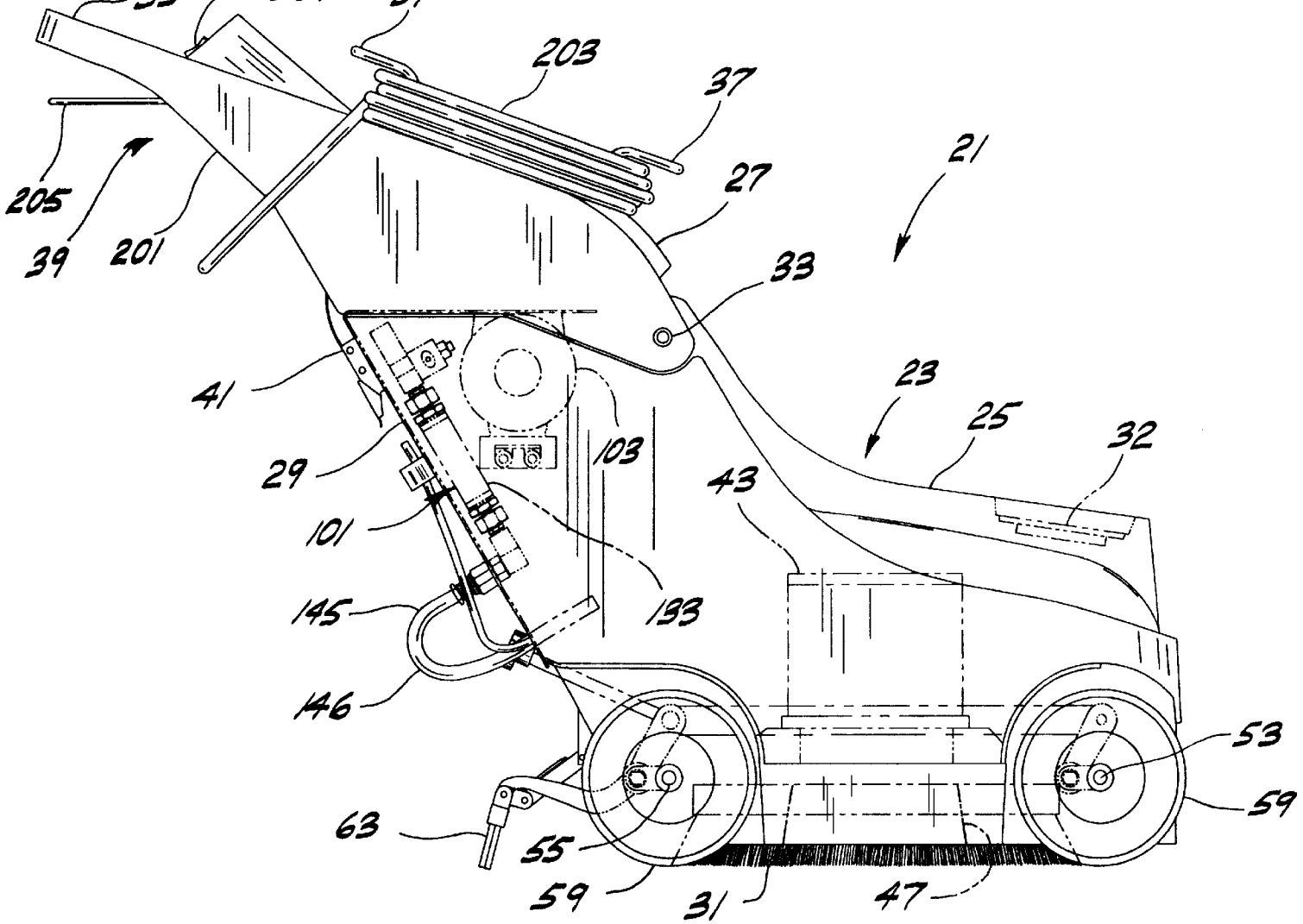
FIG. 2 is a side schematic of the floor cleaning machine of FIG. 1 showing internal components of the machine.

With reference to the various drawings and particularly to FIGS. 1 and 2, a floor cleaning machine used particularly for cleaning carpets is generally indicated at 21. The cleaning machine includes a housing, generally indicated at 23, comprising a main portion 25, a handle portion 27 and a rear access panel 29. The main portion 25 of the housing 23 is mounted on a generally rectangular chassis 31 and is shaped to partially define a solution tank for containing a liquid cleaning solution, such as a mixture of water and a concentrated cleaning chemical, to be applied to the carpet. As an example, the tank of the illustrated embodiment is constructed of polyethylene and is sized for containing up to about five gallons of cleaning solution. The main portion 25 includes a closure 32 for the tank to permit access to the tank for pouring the solution into the tank.

Figure 3:
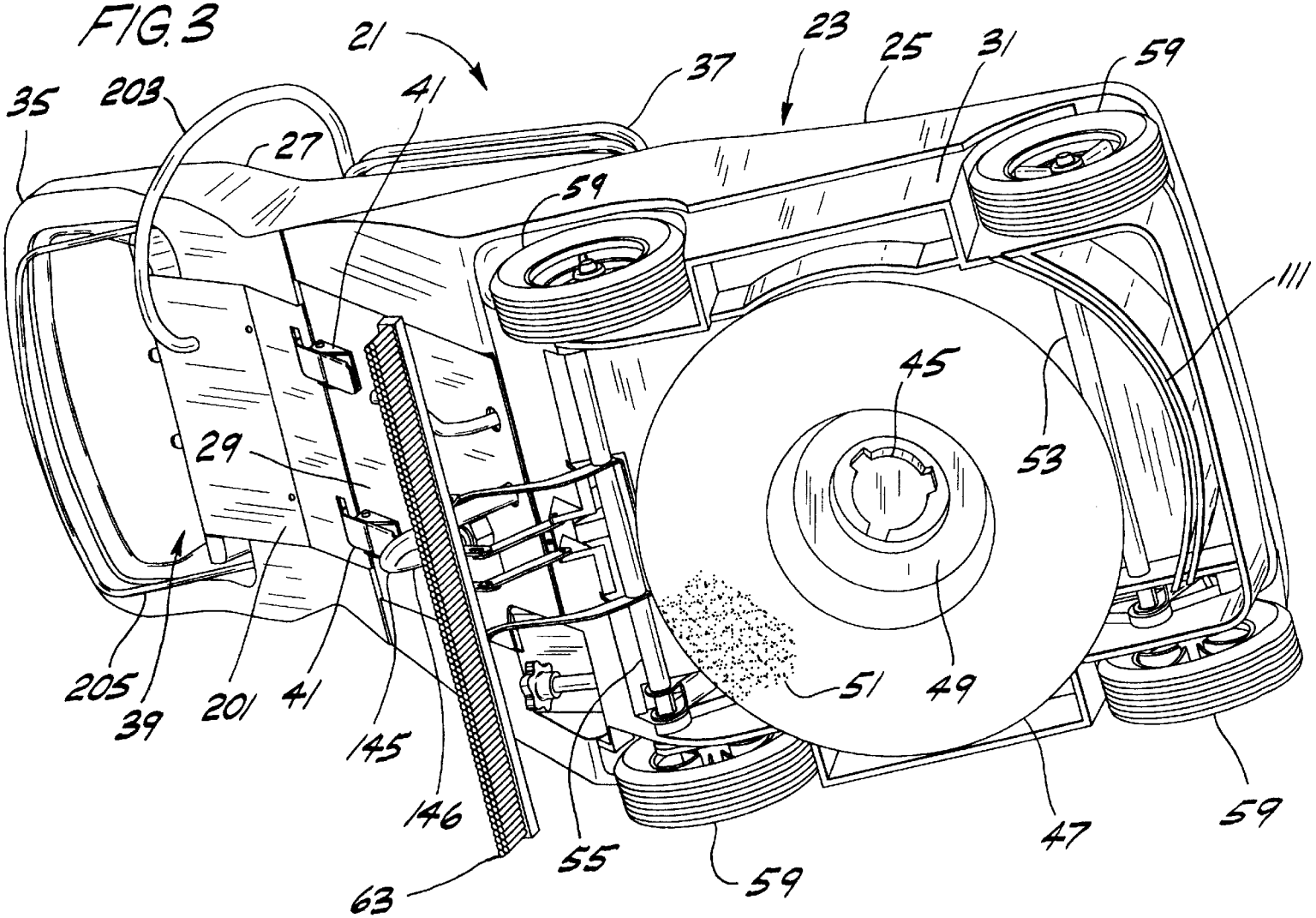
FIG. 3 is a perspective of the floor cleaning machine of FIG. 1 rotated to show the bottom of the cleaning machine.

The handle portion 27 of the housing 23 is constructed of the same material as the main portion 25 of the housing and is pivotally connected to the main portion by a rod 33 extending generally laterally through the handle portion and main portion of the housing to permit access to components within the housing for servicing and maintenance. The handle portion is releasably secured to the main portion of the housing against pivoting movement during operation of the machine 21 by latching mechanisms 41 (FIGS. 2 and 3). A cord rack 37 is mounted on the handle portion 27 of the housing 23 and is oriented for wrapping an electrical cord 203 around the rack to store the cord onboard the cleaning machine 21 when the machine is not in use. A control assembly (indicated generally at 39 in FIG. 2) is mounted on the handle portion 27 of the housing 23 for controlling operation of the cleaning machine 21. The rear access panel 29 is constructed of steel and is secured to the main portion 25 of the housing 23 by suitable fasteners 42 (FIG. 4).

Figure 4:
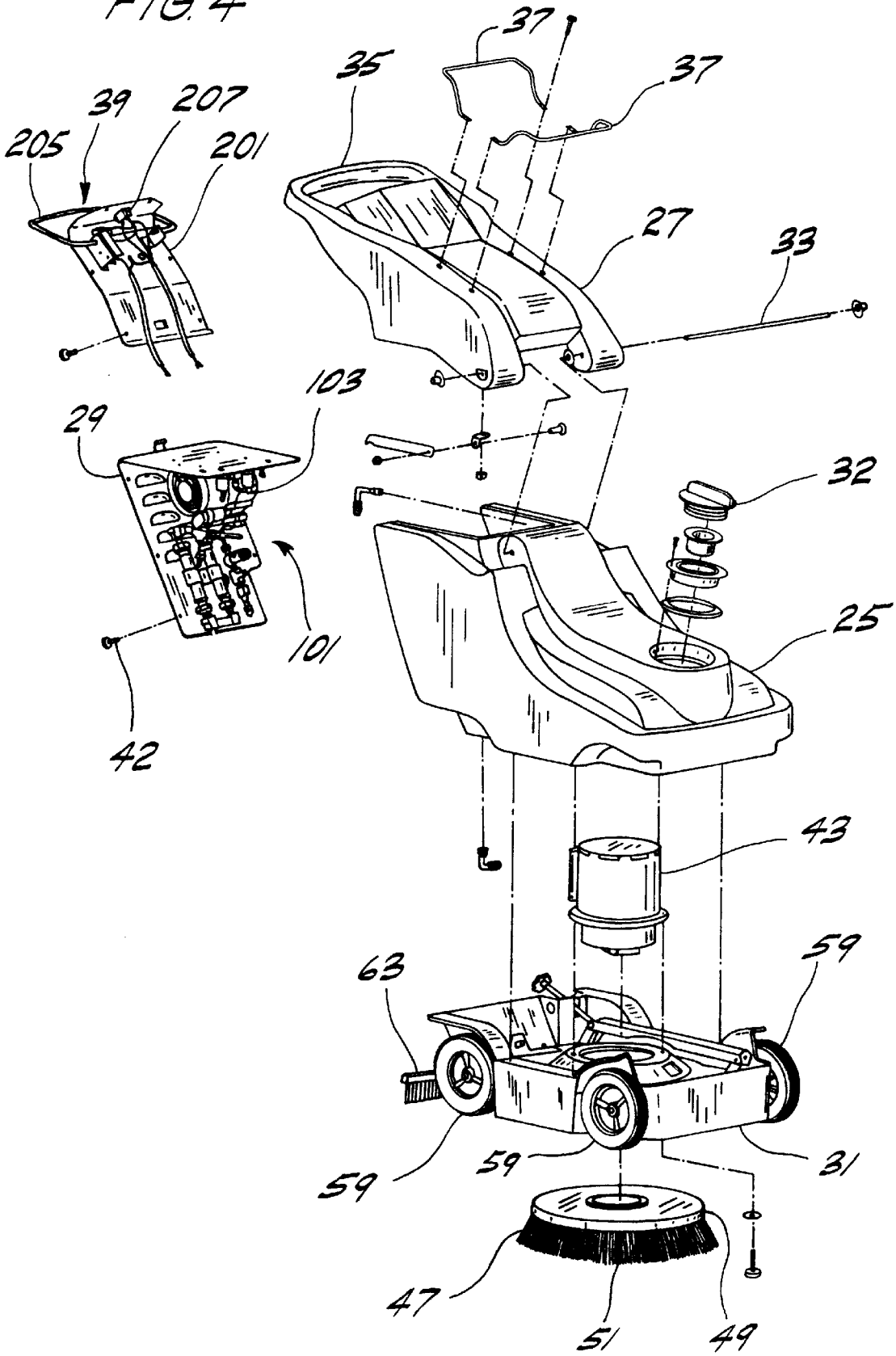
FIG. 4 is an exploded perspective of the floor cleaning machine of FIG. 1.
Figure 5:
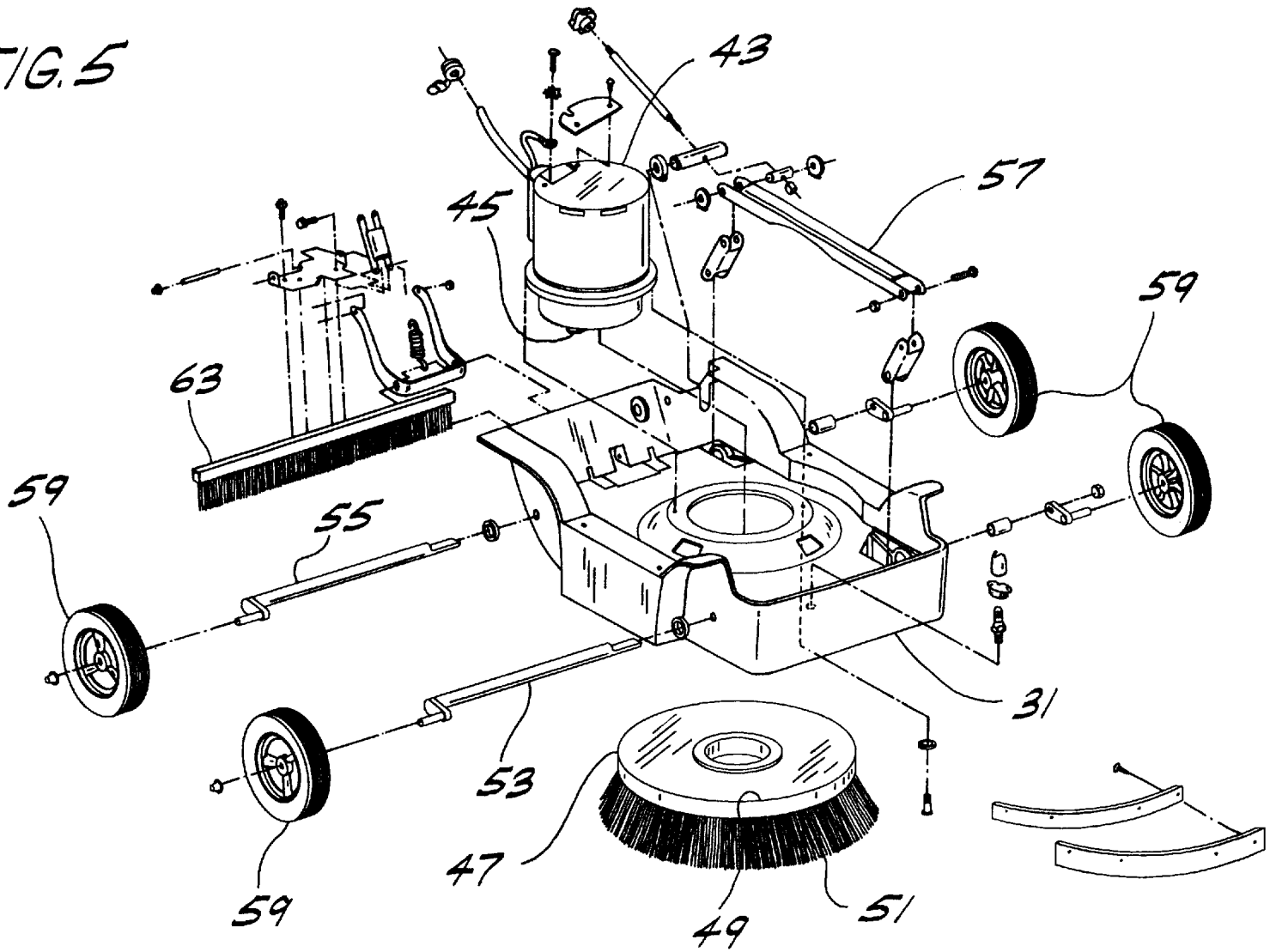
FIG. 5 is an exploded perspective of a portion of the floor cleaning machine of FIG. 1 showing a chassis and various internal components of the cleaning machine.

With reference to FIGS. 4 and 5, a brush motor 43 is generally centrally mounted on the chassis 31 within the main portion 25 of the housing 23. The motor 43 is drivingly connected to a spindle 45 for driving rotation of the spindle about a longitudinal vertical axis of the spindle. The spindle 45 extends down through the chassis 31 for releasably mounting an annular brush 47 including a brush plate 49 and nylon bristles 51 beneath the chassis for conjoint rotation with the spindle about the longitudinal axis of the spindle. Front and rear axles 53, 55 are mounted on the chassis 31 and are operatively linked by a connecting link 57 extending longitudinally between the axles. Wheels 59 are mounted on the axles 53, 55. In the preferred embodiment, the axles 53, 55 are mounted on the chassis 31 such that the annular brush 47 is slightly canted relative to the chassis. More particularly, the brush 47 is canted about ¼ inches from front to back and 1/16 inches from side-to-side. Canting the brush 47 in this manner provides a degree of self-propulsion to the cleaning machine 21 and allows foam generated by the machine to pass a sufficient distance under the brush to inhibit the foam from being pushed aside by the leading edge of the annular brush. A generally comb-like pile lifting brush 63 is attached to and extends down from the rear of the chassis 31 for lifting the carpet after the brush has passed over a portion of the carpet being cleaned.

Figure 7:
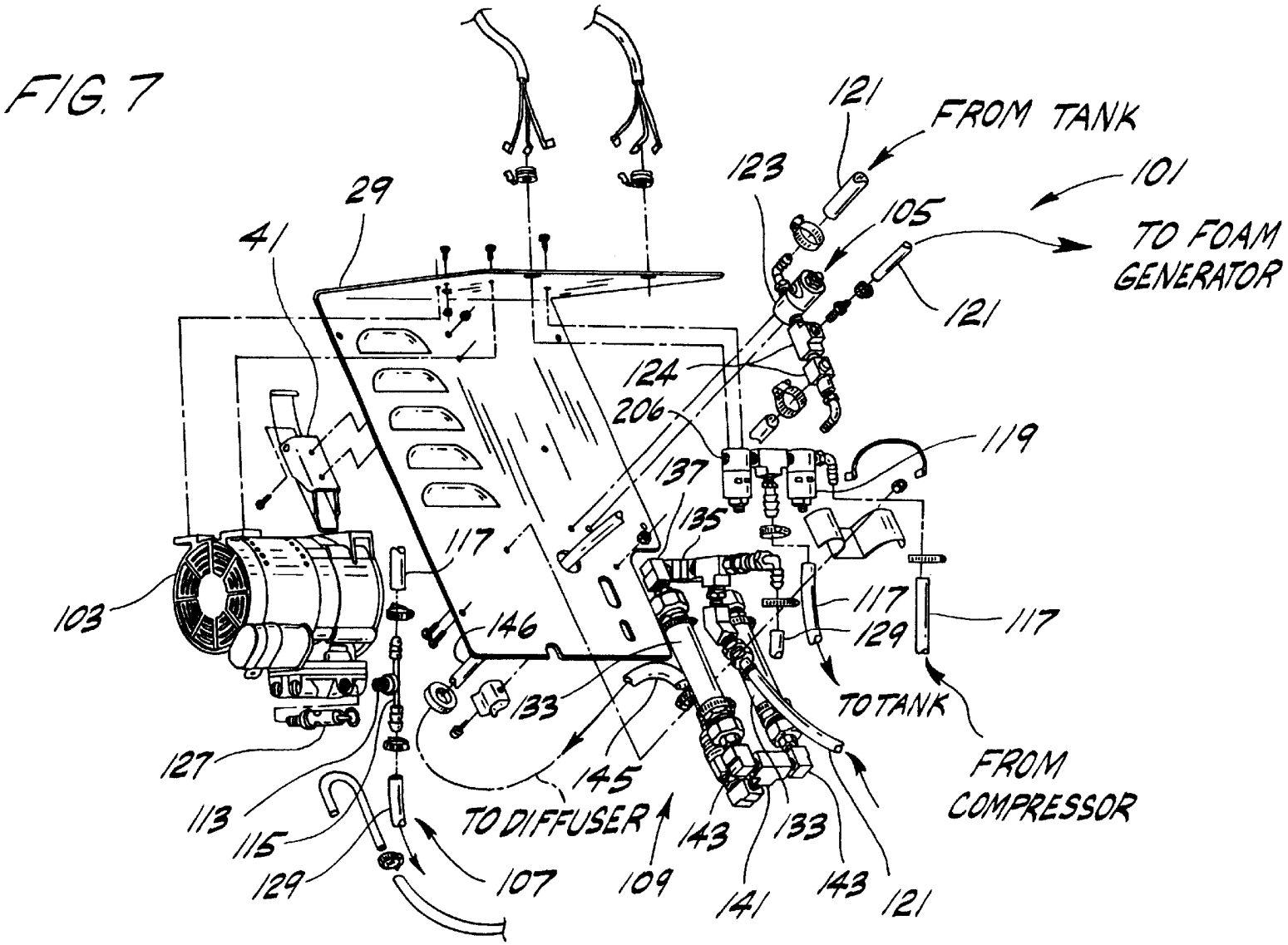
FIG. 7 is an exploded perspective of yet another portion of the floor cleaning machine of FIG. 1 showing an access panel and chemical foaming system of the present invention and flow arrows indicating the direction of flow of the system.
Figure 8:
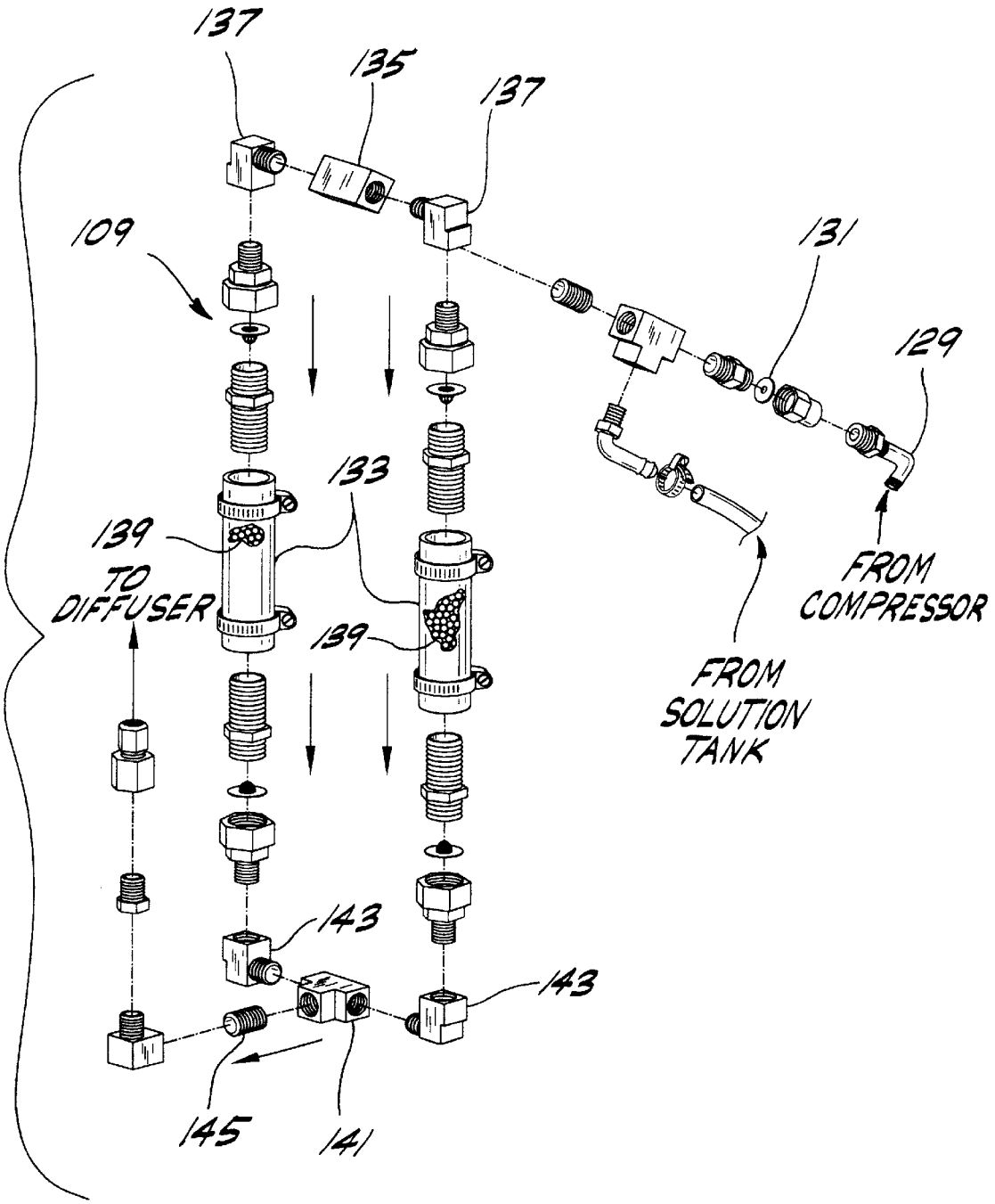
FIG. 8 is an exploded view of a portion of the chemical foaming system of FIG. 7 including flow arrows indicating the direction of flow of the system.
Figure 9:
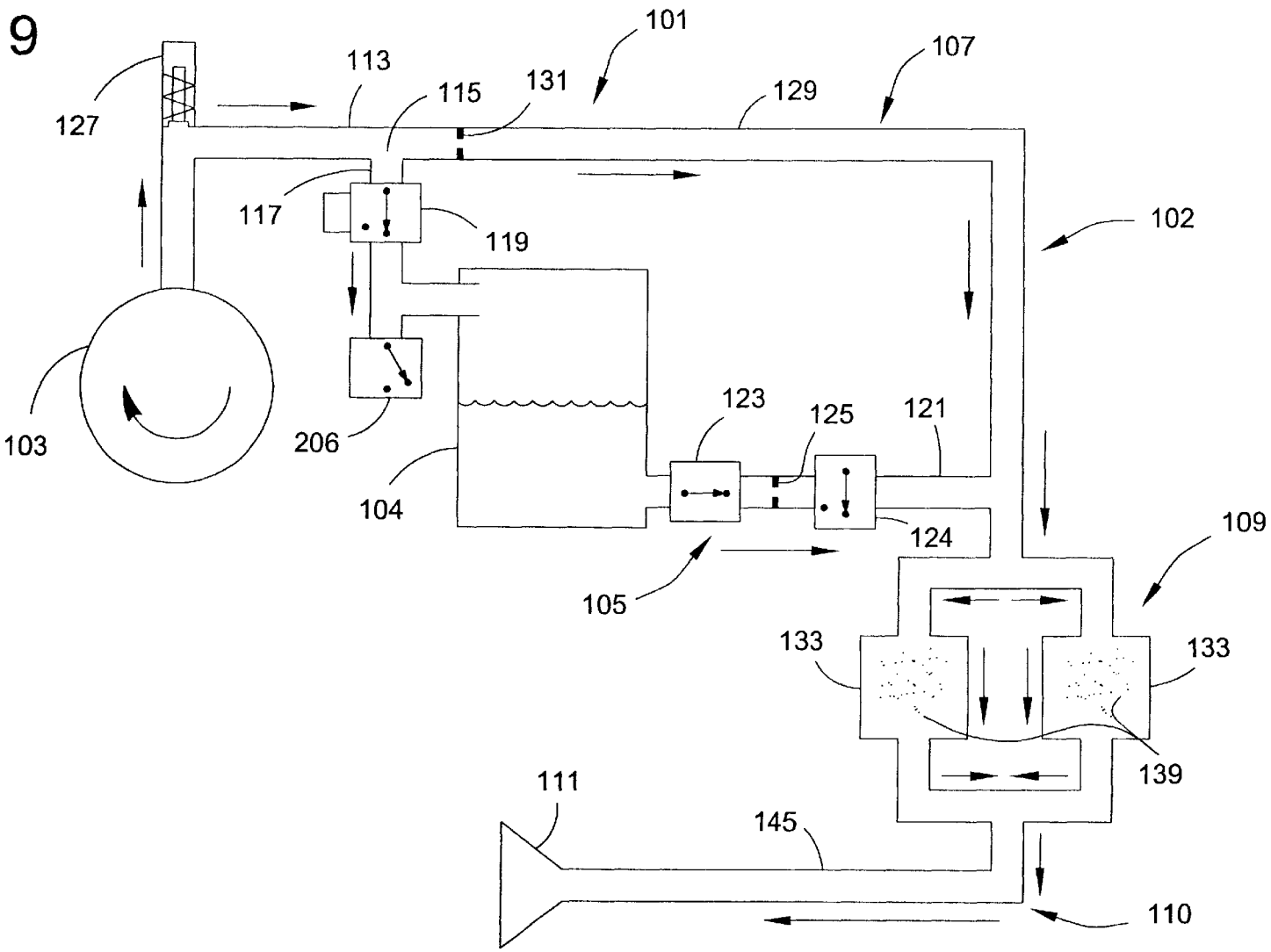
FIG. 9 is a schematic illustration of the chemical foaming system of the present invention including flow arrows indicating the direction of flow of the system.

Now referring to FIGS. 7–9, a chemical foaming system of the present invention for delivering the cleaning solution to the carpet in the form of a dry foam is generally indicated at 101. The foaming system 101 is disposed in the housing 23 rearward of the brush motor 43 and is generally secured to the rear access panel 29 of the housing 23. The foaming system 101 includes a delivery system (generally indicated as 102 in FIG. 9) for conveying pressurized fluid, such as air, and liquid cleaning solution, a foam generator (generally indicated as 109) that receives the pressurized air and cleaning solution and generates a foam therefrom, and a dispensing system (generally indicated as 110 in FIG. 9) generally comprising a dispensing line 145 and a diffuser 111 mounted on the chassis 31 near the front of the chassis for directing foam produced by the foam generator onto the carpet forward of the brush 47. The delivery system 102 includes a fluid delivery system, generally indicated at 107, for delivering pressurized fluid to the foam generator 109 and a solution delivery system, generally indicated at 105, for delivering cleaning solution to the foam generator. The fluid delivery system is in fluid communication with an air compressor 103 defining a source of pressurized fluid. A particularly preferred air compressor 103 is manufactured by Thomas Ind. of Sheboygan, Wis. under model designation #639CE44.

A connection line 113 is connected to the air compressor 103 and has a T-connector 115 at its end downstream from the compressor for directing a portion of pressurized air from the compressor to the solution delivery system 105 and the remaining portion of pressurized air to the fluid delivery system 107. The solution delivery system 105 includes a fluid line 117 connected to the T-connector 115 for receiving pressurized air from the air compressor 103 and directing the pressurized air to a solution tank (indicated as 104 in FIG. 9) containing chemical cleaning solution to pressurize the tank. A solenoid valve 119 in the fluid line 117 between the T-connector 115 and the solution tank 104 is operable between an open position in which pressurized air is permitted to flow to the solution tank and a closed position in which pressurized air is substantially blocked against flowing to the solution tank. One preferred solenoid valve 119 is a two-way solenoid valve commercially available from KIP, Inc. of Farmington, Conn. under model designation #351118.

A solution delivery line 121 is connected to the tank 104 for carrying solution forced from the tank to the foam generator 109. A solenoid valve 123 disposed in the solution delivery line 121 is operable between an open position in which solution is permitted to flow out of the solution tank 104 and a closed position in which solution is blocked against flowing out of the tank. One preferred solenoid valve 123 is available from KIP, Inc. under model designation #351166. Another solenoid valve 206 (FIG. 9), or shunt valve, is opened when the cleaning machine 21 is turned off after operation to vent pressure from the system 101. A metering orifice 125 in the solution delivery line 121 restricts the flow of solution through the delivery line to meter the flow of cleaning solution to the foam generator 109 when the solenoid valve is in its open position. In the illustrated embodiment, the metering orifice 125 has a diameter of about 0.098 inches. A drain valve 124 in the solution delivery line 121 between the valve 123 and metering orifice 125 allows for draining of the solution tank 104 for servicing and maintenance. A relief valve 127 is also connected to the air compressor 103 to exhaust pressurized air from the foaming system 101 when the pressure exceeds a predetermined pressure limit. For example, the relief valve 127 of the illustrated embodiment exhausts pressurized air from the system 101 when the pressure exceeds about 12 psi.

The pressurized fluid delivery system 107 includes a fluid line 129 connected to the T-connector 115 and extending directly to the foam generator 109 to permit pressurized air from the compressor 103 to bypass the solution delivery system 105. The solution delivery line 121 leading from the solution tank 104 connects to the fluid line 129 slightly upstream from the foam generator 109 so that cleaning solution from the solution tank mixes with the pressurized air in the fluid line slightly upstream from the foam generator 109. A charge orifice 131 is disposed in the fluid line 129 generally adjacent the T-connector 115 to restrict the flow of pressurized air through the fluid line. Restricting the air flow in this manner causes an increase in the air pressure upstream from the charge orifice 131, resulting in an increased pressure within the solution tank 104 to force fluid from the tank. Thus, it will be seen that providing the charge orifice regulates the flow of solution from the solution tank by regulating the pressure in the tank. Restricting the air flow also increases the flow velocity of air flowing through the fluid line 129 downstream of the charge orifice 131 to the foam generator 109, thereby speeding up foam generation upon initiation of foam production. As an example, the charge orifice of the illustrated embodiment has a diameter of about 0.107 inches.

Referring particularly to FIG. 8, the foam generator 109 includes a pair of tubes 133 in generally parallel spaced relationship with each other. A T-connector 135 having opposing elbows 137 (broadly, inlet lines) connected thereto connects the fluid line 129 to the tubes 133 to direct a portion of the cleaning solution and pressurized air mixture entering the foam generator 109 to each of the tubes such that the tubes are in generally parallel flow relationship with each other. Each tube 133 is filled with a foaming media capable of producing foam caused by shearing action, entrainment or a combination of both. In the preferred embodiment, the tubes 133 are filled with glass beads 139. The lengths and diameters of the tubes 133, as well as the diameters of the glass beads 139, are sized so as to maintain the operating pressure of the foaming system 101 within a desired level by inhibiting the increase of fluid pressure upstream of the foam generator 109. As an example, the operating pressure in the solution tank 104 of the foaming system 101 is about 10 psi. As shown in FIG. 7, the tubes 133 of the illustrated embodiment are arranged in an inclined orientation and preferably positioned upright so that cleaning liquid delivered to the tubes flows generally evenly down into the tubes. However, it is understood that the tubes 133 may be horizontal, or at some inclination other than that shown in the drawings without departing from the scope of the invention.

The bead diameter and tube length also affect the quality of the foam generated in the tubes 133. More particularly, using larger beads allows for easier passage of the foam through the tubes 133 since there are fewer contact, or blocking, points between beads 139 in the tube. However, the larger beads 139 also result in larger foam bubbles. By using sufficiently long tubes 133 filled with the larger beads 139, large foam bubbles formed near the upstream end of the tubes will impact other beads while flowing through the tubes. This impact breaks down the large bubbles into more desirable smaller bubbles prior to reaching the downstream ends of the tubes 133. Smaller bubbles are more favorable for producing a thicker foam. As an example, the tubes 133 of the illustrated embodiment are each about 3.625 inches long and have an inner diameter of approximately 1 inch. The beads 139 are soda lime glass beads having diameters of about 4 mm. The total weight of the beads 139 in each tube is approximately 69.7 grams.

A second T-connector 141 (FIG. 8) and opposing elbows 143 (broadly, outlet lines) are connected to the downstream ends of the tubes 133 to combine the streams of foam produced in the tubes and to direct a single stream of foam into the dispensing line 145 leading from the T-connector to the foam diffuser 111 where foam is exhausted from the cleaning machine 21. Dividing the flow of mixture into two separate tubes 133 and then recombining the resulting foam exiting the tubes substantially reduces and inhibits back pressure from being generated in the foam generator 109 each time foam generation is initiated by the operator. More particularly, if only one tube is used, foam generated in the tube upon initiation of foaming inhibits the flow of air through the tube, causing the pressure in the system upstream of the tube to increase. If this pressure exceeds the pressure in the solution tank, the flow of solution from the tank to the fluid line 129 is substantially inhibited, thereby reducing the effectiveness of the foam generator 109 and causing a delay in the cleaning process while the excess pressure is relieved.

In the present invention, where at least two tubes 133 are used in parallel, the air and cleaning solution mixture flowing into the foam generator 109 is divided between the tubes. If foam generated in one of the tubes 133 thickens to the extent that air flow through the tube causes pressure to increase upstream of the tube, the increased pressure causes more air to flow into the other tube to relieve pressure rather than increase the pressure in the system upstream of the foam generator. This allows the foaming system 101 to more rapidly reach a balanced or steady operating state, thereby reducing or eliminating the risk of delay in the cleaning process.

As shown in FIG. 2, a transparent portion 146 of the dispensing line 145 carrying the foam from the T-connector 141 downstream of the tubes 133 extends outward through an opening in the rear access panel 29 and then back into the housing 23 through a second opening in the panel prior to extending to the diffuser 111 to permit visual verification by the operator that foam is being generated by the foaming system 101. In the preferred embodiment, the dispensing line 145 is sized to inhibit any voids or space unoccupied by foam. The end length of the diffuser 111 is sized according to the desired span of foam beneath the cleaning machine 21. A screed (not shown) is preferably attached to the underside of the chassis 31 intermediate the diffuser 111 and the brush 47 and extends down from the chassis but above the carpet to level down the foam deposited on the carpet to a desired thickness prior to the brush traveling over the carpet.

Figure 6:
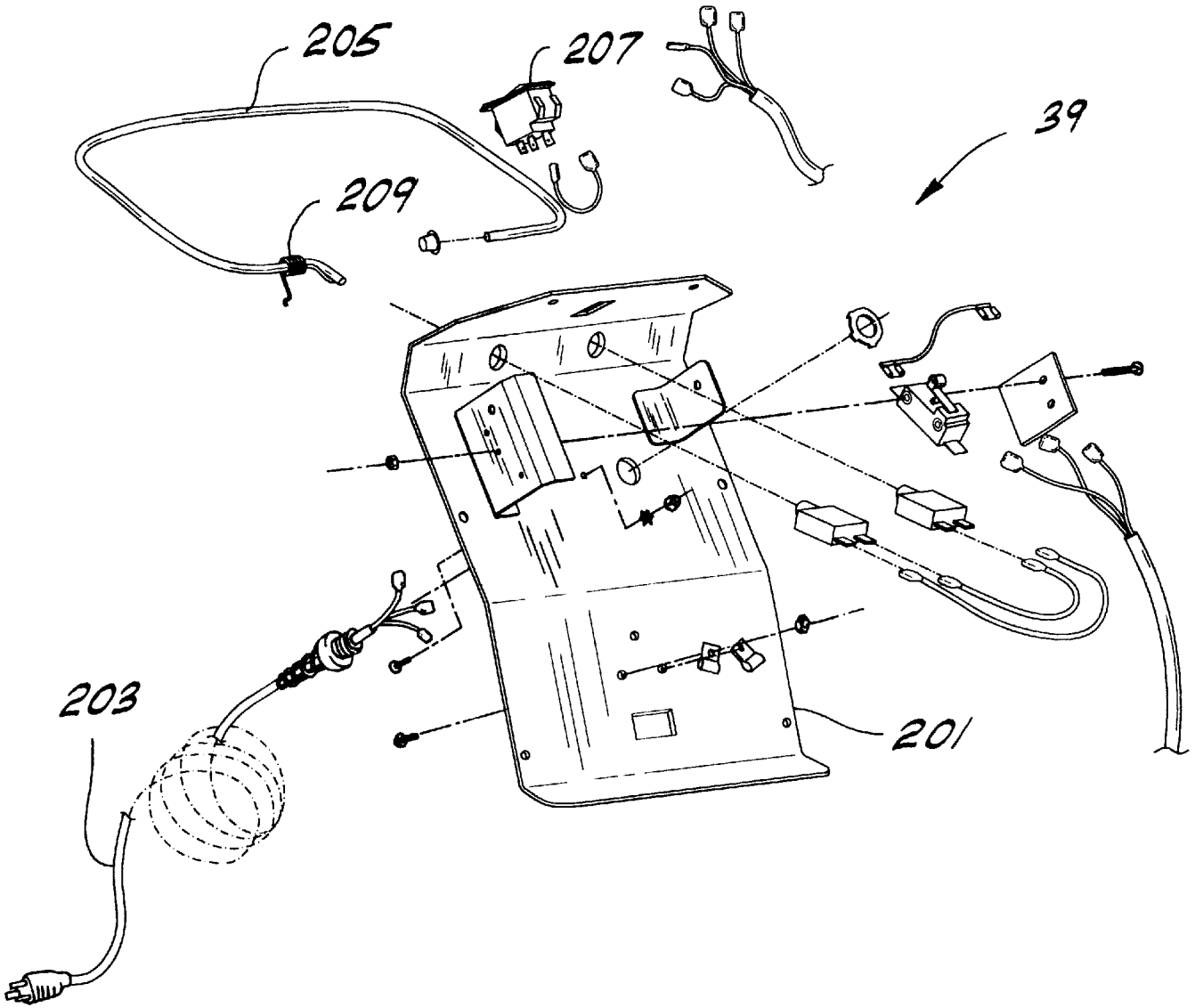
FIG. 6 is an exploded perspective of another portion of the floor cleaning machine of FIG. 1 showing a control assembly of the cleaning machine.
Figure 10:
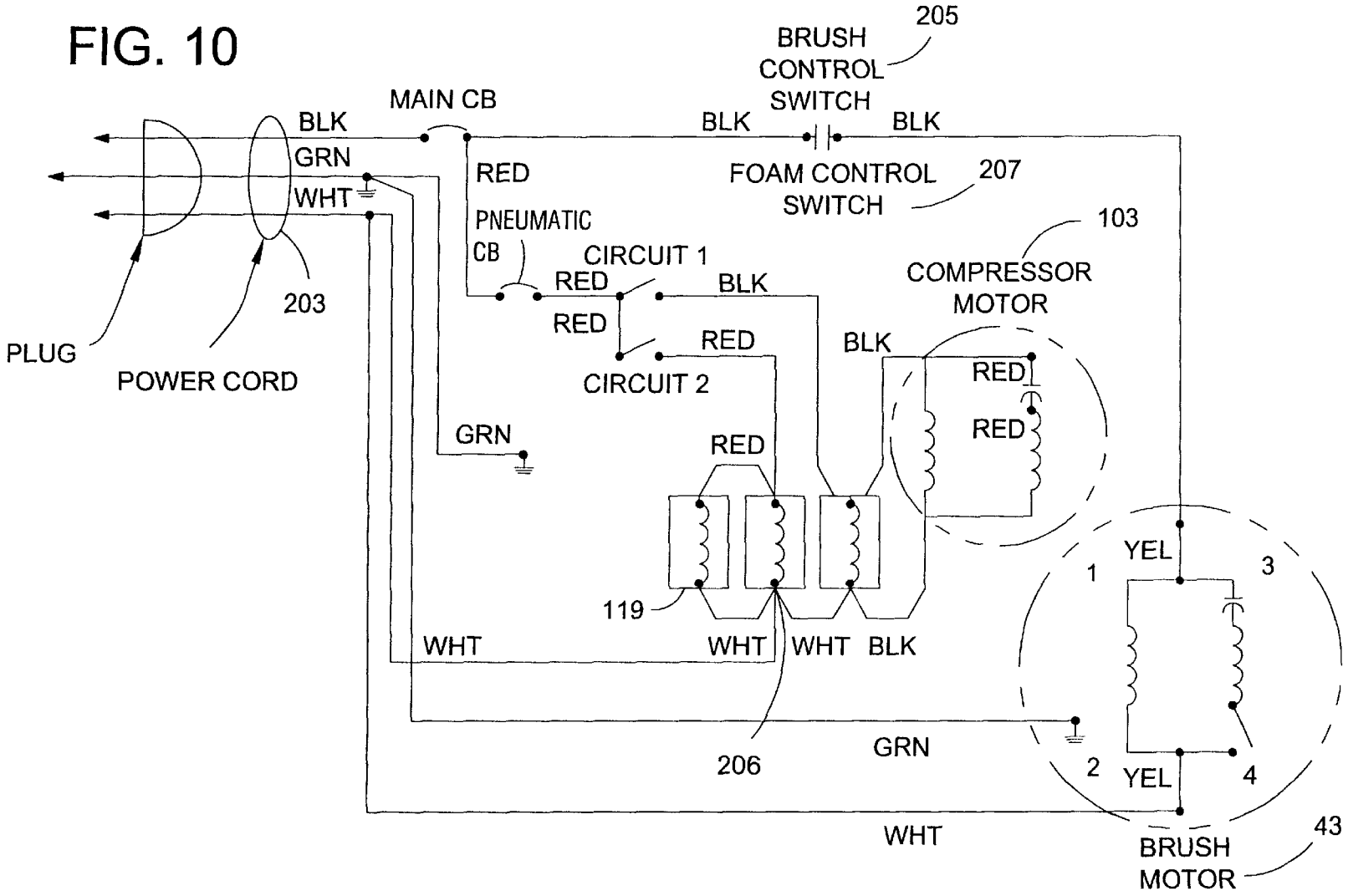
FIG. 10 is a schematic wiring diagram of the floor cleaning machine of FIG. 1.

Referring to FIGS. 6 and 10, the control assembly 39 comprises a control panel 201, the electrical cord 203, a brush control lever 205 and a foam control switch 207. The electrical cord 203 is secured to the control panel 201 and is electrically connected to the air compressor 103, the solenoid valves 119, 123 and the brush motor 43. The brush control lever 205 is pivotally attached to the control panel 201 for pivoting movement by the operator relative to the handle portion 27 of the housing 23 between a cleaning position in which the lever is generally adjacent the handle 35 and a non-cleaning position in which the lever is spaced from the handle. In the cleaning position of the brush control lever 205, electrical current is permitted to flow to the brush motor 43 to operate the brush motor. A coil spring 209 mounted on the brush control lever 205 biases the lever to its non-cleaning position.

The foam control switch 207 is mounted on the control panel 201 and is electrically connected to the solenoid valves 119, 123 and air compressor 103 for controlling operation of the chemical foaming system 101. The switch 207 is preferably a three position switch movable between an on position in which foam is produced and dispensed onto the floor, a standby position in which foam production is halted but the pressure in the solution tank 104 is maintained and the cleaning machine 21 is still operable, and an off position in which pressure in the foaming system 101 is vented through the shunt valve 206 and the machine is inoperable. In the on position of the foam control switch 207, the solenoid valves 119, 123 are moved to their open positions to permit the flow of pressurized air into the tank 104 and to permit the flow of solution from the tank to the foam generator 109. In the standby position, the solenoid valves 119, 123 are both moved to their closed positions. This prevents pressurized air from flowing into the tank 104 and further prevents solution from flowing out of the tank, thereby preserving the pressure within the solution tank so that foam generation can be resumed generally immediately upon moving the switch 207 back to its on position.

In operation, the electrical cord 203 is plugged into an electrical outlet and the foam control switch 207 is moved to the on position (e.g., the solenoid valves 119, 123 are both in the open position) while the brush control lever 205 is in its non-cleaning position. Electrical current flows to the air compressor 103 to generate pressurized air in the chemical foaming system 101. The pressurized air is directed through the fluid line 113 leading from the air compressor 103 to the T-connector 115. As pressurized air flows ftrough the charge orifice 131 in the fluid line 129, air pressure behind (e.g., upstream of) the orifice increases, thereby pressurizing the solution tank 104 to a pressure sufficient to force cleaning solution from the tank through the delivery line 121. The flow velocity of air flowing through the fluid line 129 increases after passing through the charge orifice to reduce the amount of time it takes for foam production to start. Cleaning solution forced from the solution tank 104 flows through the metering orifice 125 and valve 123 in the delivery line 121 and is directed into the fluid line 129 for admixture with the pressurized air slightly upstream of the foam generator 109.

The mixture of pressurized air and cleaning solution flows into the T-connector 135 upstream of the bead-filled tubes 133 and is diverted into the tubes. As the mixture flows past the beads 139 in the tubes 133, foam bubbles are generated through shearing action, entrainment or both. As the foam in the tubes 133 thickens the pressure in the system upstream of the tubes tends to increase. If the pressure in one tube 133 increases to a pressure greater than that in the other tube, more air will be forced into the less pressurized tube until the pressure is balanced. This reduces the possibility that pressure in the fluid line 129 upstream of the tubes 133 will become greater than the pressure in the solution tank 104 and inhibit solution from flowing out of the tank. The foam flows from the downstream ends of the tubes 133 and combines within the T-connector 141 downstream of the tubes to form a single stream of foam directed through the dispensing line 145. As foam flows through the dispensing line 145, the operator visually confirms that foam production is occurring by viewing the foam flowing through the transparent section 146 of the diffuser line that extends outward of the rear access panel 29 of the housing 23.

After confirming foam production, the operator pulls up on the brush control lever 205 to pull the lever to its cleaning position adjacent the handle 35. The brush motor 43 is operated upon receiving a signal from the brush control lever 205 to rotate the annular brush 47 beneath the chassis 31. The cleaning machine 21 is then moved forward, with the foam being dispensed from the diffuser 111 at the front of the chassis 31. As the cleaning machine 21 moves forward, the screed levels the foam to a desired thickness and the brush 47 moves over the foam to work the foam into the carpet, thereby cleaning the carpet. Finally, the pile lifting brush 63 moves over the cleaned portion of the carpet to lift pile that has been matted down by the brush 47.

When the cleaning machine 21 is to be turned around, or stopped momentarily for adjusting the electrical cord 203 or tending to other matters, foam production should be halted to prevent excessive foam from being dispensed onto the carpet. To this end, the foam control switch 207 is moved to its standby position. In reaction, the solenoid valves 119, 123 are both moved to their closed positions, thereby sealing the solution tank against delivering solution to the foam generator 109 while also maintaining the pressure within the tank. When the turn is completed or cleaning is otherwise to be continued, the foam control switch 205 is moved back to the on position to open the solenoid valves 119, 123. Because the pressure was maintained within the solution tank in the standby position of the foam control switch 205, foam production is restarted quickly after moving the switch back to the on position.

In view of the above, it will be seen that the several objects of the invention are achieved and other advantageous results attained. Placing a charge orifice 131 in the fluid line 129 adjacent the T-connector 115 causes back pressure behind the orifice to build in the solution tank 104 to a pressure sufficient to force solution from the tank. This allows the air compressor 103 to be used for both foam generation (via the fluid line 129) and for forcing solution from the tank 104. By using two bead filled tubes 133 for generating foam, a substantial increase in pressure in one of the tubes caused by the foam in the tube inhibiting flow therethrough, is relieved by allowing a greater volume of air to flow to the other tube. This inhibits the increased pressure from backing up within the fluid line 129 and inhibiting the flow of solution from the tank 104 through the solution delivery line 121 and into the fluid line, assuring little delay in foam production each time the foam control switch 205 is moved to its on position.

As various changes could be made in the above methods without departing from the scope of the invention, it is intended that all matter contained in the above description or shown in the accompanying drawings shall be interpreted as illustrative and not in a limiting sense.

What is claimed is:

1. A chemical foaming system for use in a floor cleaning machine, the foaming system comprising:

a foam generator, a delivery system upstream of the foam generator in communication with a source of pressurized fluid and a source of liquid cleaning solution, the delivery system delivering pressurized fluid and liquid cleaning solution to the foam generator; and a dispensing system downstream of the foam generator for dispensing foam generated by the foam generator onto the floor being cleaned;

the foam generator comprising a pair of independent foaming chambers in generally parallel flow relationship intermediate the delivery system and the dispensing system whereby a portion of pressurized fluid and liquid cleaning solution delivered to the foam generator by the delivery system flows into one of the foaming chambers and the remaining portion of the pressurized fluid and liquid cleaning solution delivered to the foam generator flows into the other foaming chamber, each foaming chamber being adapted for generating a foam therein for dispensing onto the floor by the dispensing system, each foaming chamber having an upstream end in fluid communication with the delivery system for receiving a respective portion of the pressurized fluid and a downstream end in fluid communication with the dispensing system for exhausting foam generated within the chamber, the upstream ends of the foaming chambers being in fluid communication with each other substantially downstream of the source of pressurized fluid whereby an increase of fluid pressure in one of said foaming chambers causes a decreased portion of the pressurized fluid to flow to the one foaming chamber and an increased portion of pressurized fluid to flow to the other foaming chamber without substantially increasing the fluid pressure of pressurized fluid in the delivery system.

2. A chemical foaming system as set forth in claim 1 wherein the foaming chambers are each defined by a tube, the tube being filled with a foaming media for facilitating formation of the foam by at least one of shear action and entrainment as the pressurized fluid and chemical cleaning liquid flow through the tube.

3. A chemical foaming system as set forth in claim 2 wherein the foaming media is glass beads.

4. A chemical foaming system as set forth in claim 3 wherein the beads are sized in cross-section to be at least about 4 mm.

5. A chemical foaming system as set forth in claim 1 wherein the delivery system comprises a fluid line for carrying pressurized fluid and liquid cleaning solution, a pair of inlet lines in fluid communication with the fluid line, each inlet line being in fluid communication with a respective upstream end of one of the foaming chambers for directing a portion of the pressurized fluid and liquid cleaning solution in the fluid line to the respective foaming chamber, the inlet lines being in fluid communication with each other downstream of the fluid line to provide fluid communication between the upstream ends of the foaming chambers.

6. A chemical foaming system as set forth in claim 1 wherein the dispensing system comprises a dispensing line and a pair of outlet lines, each outlet line being in fluid communication with a respective downstream end of one of the foaming chambers for receiving foam exhausted from the foaming chambers and further being in fluid communication with the dispensing line whereby foam exhausted from the foaming chambers combines in the dispensing line for dispensing onto the floor being cleaned.

7. A chemical foaming system for use in a floor cleaning machine, the foaming system comprising:

a source of pressurized fluid;

a solution tank containing a liquid cleaning solution;

a foam generator in fluid communication with the source of pressurized fluid and with the solution tank for receiving pressurized fluid from the source of pressurized fluid and liquid cleaning solution from the solution tank and generating a foam therefrom to be dispensed onto a floor being cleaned;

a first fluid line providing fluid communication between the source of pressurized fluid and the foam generator for conveying pressurized fluid to the foam generator;

a second fluid line in fluid communication with the source of pressurized fluid and the solution tank for directing a portion of pressurized fluid from the source of pressurized fluid to the solution tank to pressurize the solution tank, thereby forcing liquid cleaning solution from the tank, the remaining portion of pressurized fluid from the source of pressurized fluid being directed to flow through the first fluid line; and a restriction in the first fluid line upstream of the foam generator, the restriction having an orifice sized to restrict the flow of pressurized fluid through the first fluid line, thereby increasing the flow velocity of pressurized fluid downstream of the restriction for delivery to the foam generator, the first and second fluid lines being in fluid communication with each other upstream of the restriction such that the restriction in the first fluid line effects an increase in fluid pressure of the portion of pressurized fluid directed to the solution tank to pressurize the solution tank.

8. A chemical foaming system as set forth in claim 7 further comprising a solution delivery line leading from the solution tank for carrying cleaning solution forced from the tank, the solution delivery line being in fluid communication with the foam generator to provide fluid communication between the solution tank and the foam generator.

9. A chemical foaming system as set forth in claim 8 wherein the first fluid line and the solution delivery line are connected together substantially upstream of the foam generator such that pressurized fluid flowing through the first fluid line and cleaning solution flowing through the solution delivery line combine at the connection for flow to the foam generator.

10. A chemical foaming system as set forth in claim 8 further comprising a restriction in the solution delivery line upstream of the foam generator, the restriction having an orifice for metering the volume of chemical solution flowing to the foam generator.

11. A chemical foaming system for use in a floor cleaning machine, the foaming system comprising:

a foam generator, a delivery system upstream of the foam generator in communication with a source of pressurized fluid and a source of liquid cleaning solution, the delivery system delivering pressurized fluid and liquid cleaning solution to the foam generator; and a dispensing system downstream of the foam generator for dispensing foam generated by the foam generator onto the floor being cleaned;

the foam generator comprising a pair of independent foaming chambers in generally parallel flow relationship intermediate the delivery system and the dispensing system whereby a portion of pressurized fluid and liquid cleaning solution delivered to the foam generator by the delivery system flows into one of the foaming chambers and the remaining portion of the pressurized fluid and liquid cleaning solution delivered to the foam generator flows into the other foaming chamber, each foaming chamber being adapted for generating a foam therein for dispensing onto the floor by the dispensing system;

the delivery system comprising a fluid line for carrying substantially all of the pressurized fluid and liquid cleaning solution to be delivered to the foaming chambers, a pair of inlet lines in fluid communication with the fluid line, each inlet line being in fluid communication with a respective upstream end of one of the foaming chambers for directing a portion of the pressurized fluid and liquid cleaning solution in the fluid line to the respective foaming chamber.

12. A chemical foaming system as set forth in claim 11 wherein the inlet lines are in fluid communication with each other downstream of the fluid line to provide fluid communication between the upstream ends of the foaming chambers.

* * * * *